United States Patent [19]

Crawford et al.

[11] 4,386,924

[45] Jun. 7, 1983

[54] HANDLE BAG MAKING APPARATUS

[75] Inventors: Donald C. Crawford; John S. Aterianus, both of Green Bay, Wis.

[73] Assignee: FMC Corporation, Chicago, Ill.

[21] Appl. No.: 199,804

[22] Filed: Oct. 23, 1980

[51] Int. Cl.[3] ..... B31B 1/86

[52] U.S. Cl. ..... 493/196; 493/231; 493/235; 493/926; 493/472

[58] Field of Search ..... 493/926, 226, 193–196, 493/199–201, 203, 204, 235, 231, 227, 209, 472; 156/512

[56] References Cited

U.S. PATENT DOCUMENTS

| | | | |
|---|---|---|---|
| 3,384,097 | 5/1968 | Meeker et al. | 198/339 X |
| 3,992,981 | 11/1976 | Stock | 493/194 |
| 4,002,519 | 1/1977 | Moseley et al. | 493/209 X |
| 4,308,021 | 12/1981 | Achelpohl | 493/196 |

FOREIGN PATENT DOCUMENTS

| | | | |
|---|---|---|---|
| 2157184 | 5/1973 | Fed. Rep. of Germany | 493/200 |
| 2023063 | 12/1979 | United Kingdom | 493/926 |

*Primary Examiner*—James F. Coan

*Attorney, Agent, or Firm*—Louis J. Pizzanelli; Richard B. Megley

[57] ABSTRACT

Disclosed is a method and apparatus for producing handle bags made of thermoplastic web material by transporting segments of gusseted web to a cutting device that removes a generally rectangular portion of material to produce at least one style of a bag with handle portions that can be either gripped by hand or receive a forearm of a user. Moreover, there is disclosed apparatus for folding and collecting the bags so produced.

11 Claims, 12 Drawing Figures

FIG_6
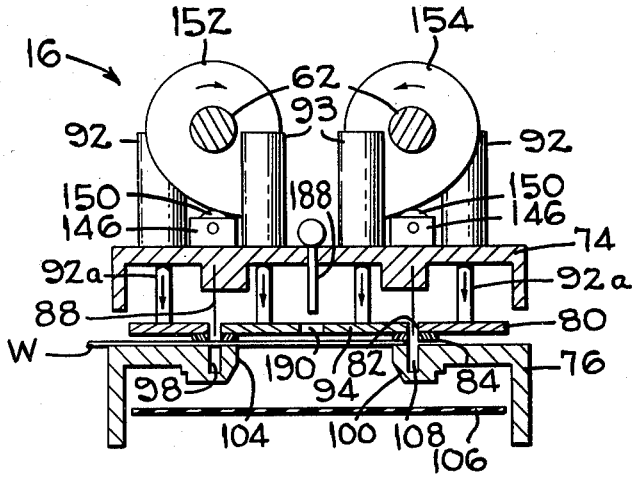
FIG_7
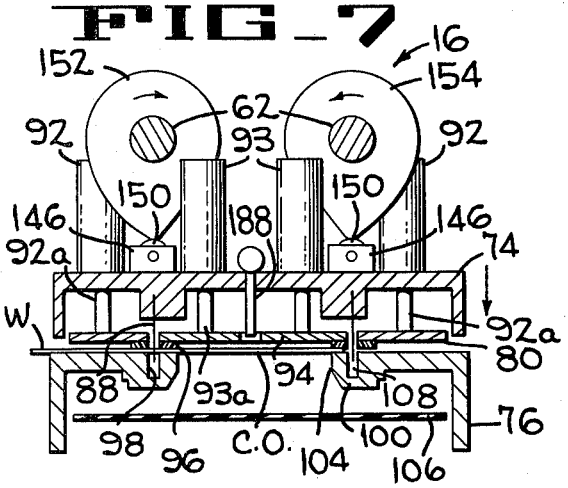
FIG_8
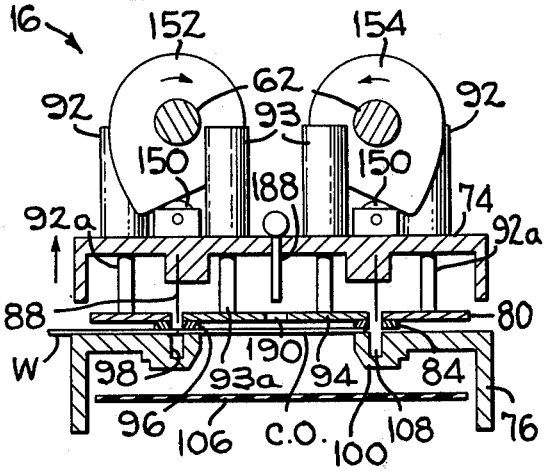
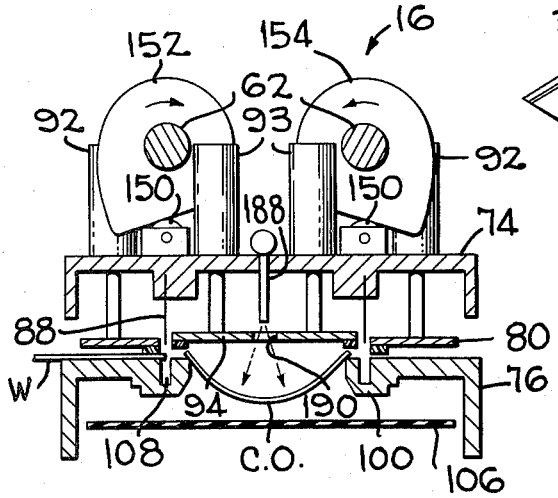
FIG_9
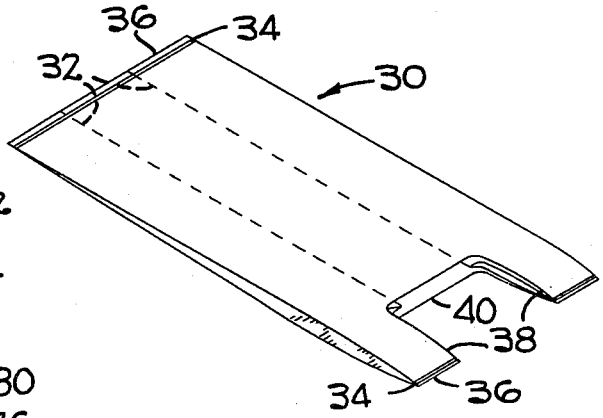
FIG_10

HANDLE BAG MAKING APPARATUS

FIELD OF THE INVENTION

The present invention relates to the manufacture of thermoplastic bags and more particularly to bags incorporating hand or arm receiving handles.

BACKGROUND OF THE INVENTION

Bags having the configuration of the bags produced by the subject matter of the present invention are generally referred to as "T shirt bags". The construction essentially comprises the creation of inwardly directed folds or gussets in tubular web material which is sealed and cut at regularly spaced intervals to produce an envelope or a pillow having each end heat sealed.

Some existing procedures transport the envelope to a stacking station which may include upstanding members, such as fences, to accumulate successive gusseted and sealed envelopes to create a stack. Once the stack is completed, it is manually removed by the operator and further processed by a press having a knife shaped to remove a generally rectangular portion from the stack of web segments. The knife cuts through the stack of web segments such that the inner extremity of the gussets and a portion of one of the transverse seals is severed, thereby creating loops which can be grasped by hand or receive the forearm of a user.

The above procedure involves certain disadvantages which relate to stack registration meaning that the corresponding edges of successive bags or web segments overlie each other so that the completed stack takes the form (much like a ream of paper or a deck of cards), the labor and time involved for manual removing and placing the stacks in machinery which effects cutting of the generally rectangular slug and the finished stacks do not easily lend themselves for cartoning in an organized fashion.

Methods and machinery are presently available for improving stack registration by interconnecting the web segments along the trailing or leading edge to maintain stack registration during manual pickoff and punching. Two known approaches are used. One involves providing heated pins or bars located adjacent the sealing station that are effective to tack weld or block the stack as it is being generated. The second approach involves a heated bar in contact with one marginal edge of the welded web segments to unify the successive segments as a stack is being created. To effect this association of web segments tack welding sometimes is restricted to the area of the bag edge which will be punched or cut out when the final stage of producing a T shirt bag is accomplished.

Certain approaches extend the tacking area of the successive bags along the entire margin of the web segment so that even after removing a rectangular segment, all of the bags are unified along the remaining edge portions. Whether heated pins are used or a heated blocking bar, the manual operation of removing the bag stack from the stacking table to the punching machine requires manual effort in removing the unified or blocked stack of bags from the bag making machine to the punching unit.

To eliminate labor costs associated with removing bag stacks from the line and improve quality, T shirt bag operations have resorted to cutting the rectangular segment from the stack of web segments on the bag machine.

Further improvements have resulted in machinery in which removal of the generally rectangular portion occurs as each web segment is produced by the bag making machine and thereafter folding the individual T shirt bag before stacking. The beneficial effects of this approach include reduction of stack dimension and the elimination of problems attendant with the extended grasping loops. As a result stack handling, cartoning and dispensing was considerably improved.

In producing the cutout of the individual bags on the bag machine certain problems, principally dealing with control of the web segment and the utilization of a shaped cutting blade propelled by pneumatic cylinders arose. Removal of the rectangular section from the web before sealing produced serious wrinkling problems which diminished the quality and accordingly the acceptability of the resulting T shirt bag. Moreover, punching or severing the generally rectangular slug from the web tube before sealing and severing required extreme accuracy in order to avoid the creation of slits or slight cuts in the bottom seal. Accuracy of this magnitude is not repetitively possible and to utilize this approach required more web for each bag.

The present state of the art incorporates rotary dies downstream of the seal bar to produce the rectangular cut-outs. This approach does fulfill the requirements of a high quality bag (one in which the rectangular cut-out is cleanly made and accurately positioned) but the rotary dies and the machine elements supporting and rotating the dies are exceedingly expensive to insure proper continuous operation and on changing bag size, replacement of the rotary dies is an expensive alteration.

SUMMARY OF THE INVENTION

A principle feature relating to the general construction and mode of operation of the present invention comprises means, synchronously operated with a bag machine associated therewith, for removing a portion of a web segment defining a bag from a predetermined location relative to the margins of such a segment, whereby the removing means operates within the time span within which the web segment is being severed and sealed by the bag making machine.

According to another feature of the present invention the means for removing a portion of the web is adjustable to assume a fixed location with respect to the sealing severing mechanism of the bag machine in order to facilitate the production of bags of the same style but of different lengths.

According to another and equally important feature of the present invention, the means for removing a portion of the advanced web segment includes a stationary platen and a cam driven platen supporting clamping members and a knife shaped in accordance with the portion to be removed, the cam driven platen is designed to create forces that minimize bending in guide pins and bushings thereby insuring longevity and clean and accurate shearing of the web.

According to another feature of the present invention the portion of the web removed from the advanced web segment is conveniently disposed out of line of the web path by providing a scrap conveyor for receiving and transporting the cut-out portion of the web transversely of the machine. Moreover, a system of bag transporting conveyor belts, enhanced maintaining the completed bag in a fixed position thereby insuring fold lines or creases to assume coordinate locations with respect to the margins of the bag.

DESCRIPTION OF THE PREFERRED EMBODIMENT

Figure 1A:
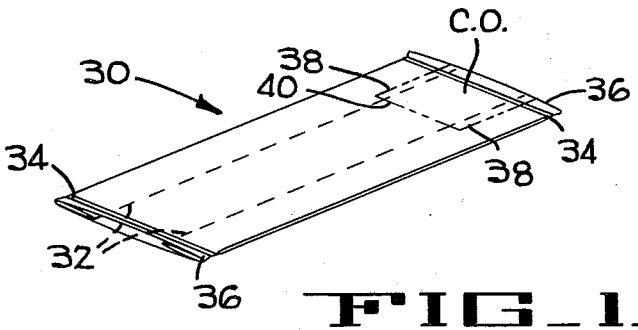
FIG. 1A is a perspective of a gusseted web segment and the location of cut lines.
Figure 1:
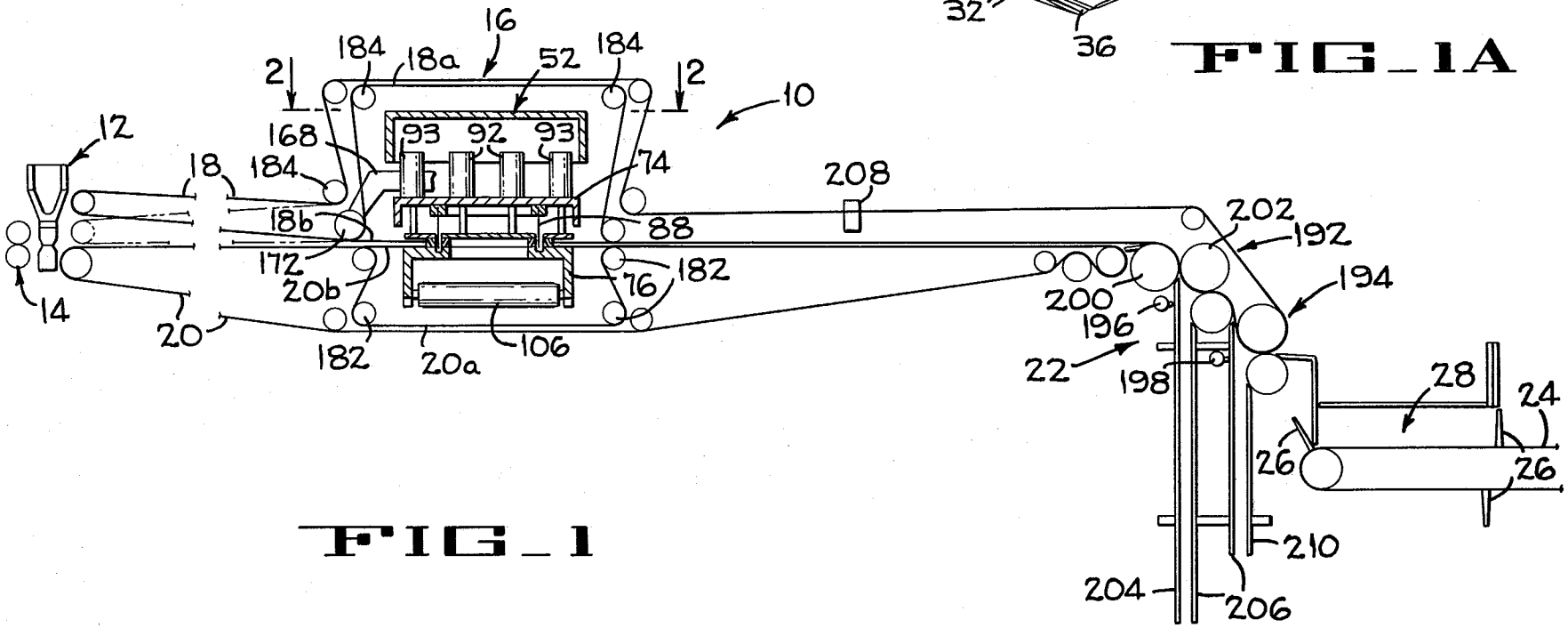
FIG. 1 is a side elevation diagramatically illustrating a T shirt bag making apparatus incorporating the novel concepts of the present invention.

With reference to FIG. 1 the T shirt bag making apparatus, generally indicated by the numeral 10, is cooperatively integrated with the operation of a bag machine of the general type shown in U.S. Pat. No. 3,663,338 which is assigned to the assignee of the present invention. The bag machine incorporates a twin sealing device 12, details of which are shown in U.S. Pat. No. 4,019,947, which is also assigned to the assignee of the present application. By reference to these patents it is intended that their disclosures be incorporated herein. Draw rolls 14, intermittently rotated by the bag machine, advance a selected segment of gusseted web W between the sealing device 12 toward a reciprocating punching mechanism 16 that removes a generally rectangular web portion from the leading portion of the advanced web segment. Upper and lower transversely spaced conveying means 18 and 20, respectively, direct and assist in properly positioning each web segment relative to the mechanism 16 and thereafter transport the completed bag to folding means 22. The folded bag is then discharged to a carton or other suitable container supported on an indexable belt 24. The belt 24 may incorporate spaced upstanding fences 26 which, when positioned at the discharge at the folding means 22 define a stacking station 28 confining the folded bags to assume a stack.

The punching mechanism 16, for cutting and removing a generally rectangular slug of material from the leading portion of the web segment or segments being fed, is positionable longitudinally relative to the seal bar 12 to insure that the rectangular slug removed thereby includes cuts penetrating the inward folds of the gussets and the leading seal at spaced intervals. FIG. 1A illustrates the cutting operation wherein a typical T shirt bag 30 is formed with inwardly extending gussets having a crease line terminating at 32. Both ends of the bag are sealed along lines 34 and a small portion of web material, usually referred to as a skirt 36, extends beyond the transverse zone of the seal 34. When a predetermined length of web segment has been fed and its leading portion is within the confines of the mechanism 16, the cutout C.O. takes the form of longitudinal incisions 38, cutting the skirt 36, the seal 34 and the inner crease of the gussets 32. The incisions 38 are interconnected by a transverse incision 40 thereby separating the cutout from the web segment and accordingly producing a T shirt bag.

According to the present invention, the reciprocating mechanism 16 for making the cutouts or removing a generally rectangular portion of material from the leading portion of the web segment operates within the time in which the seal bar 12 is creating the seals and severing the advanced web segment. Moreover, the mechanism 16 is positioned longitudinally relative to the seal bar 12 to produce T shirt bags of desired length.

Figure 2:
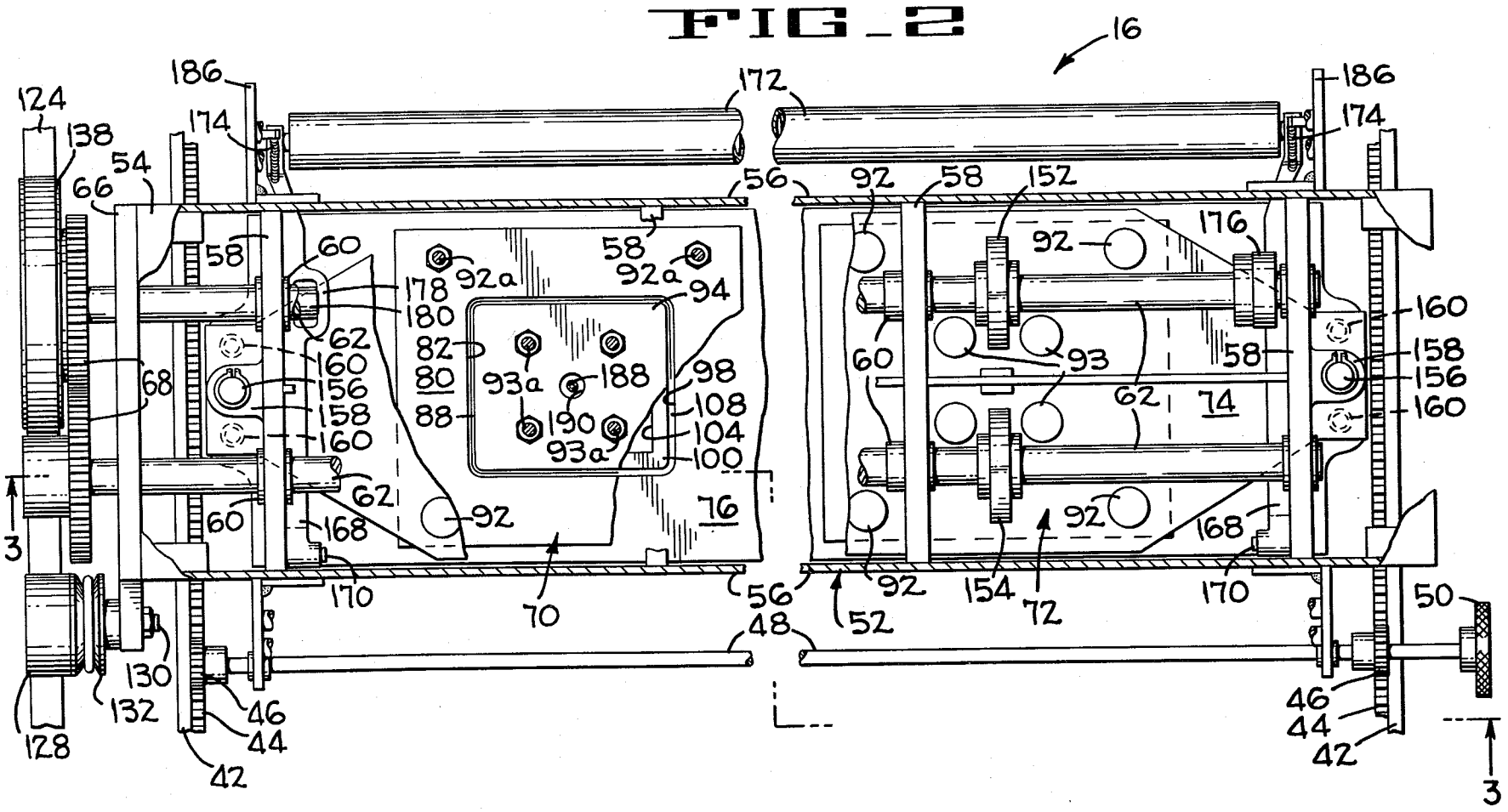
FIG. 2 is an enlarged plan with parts broken away taken substantially along the line 2—2 of FIG. 1.
Figure 3:
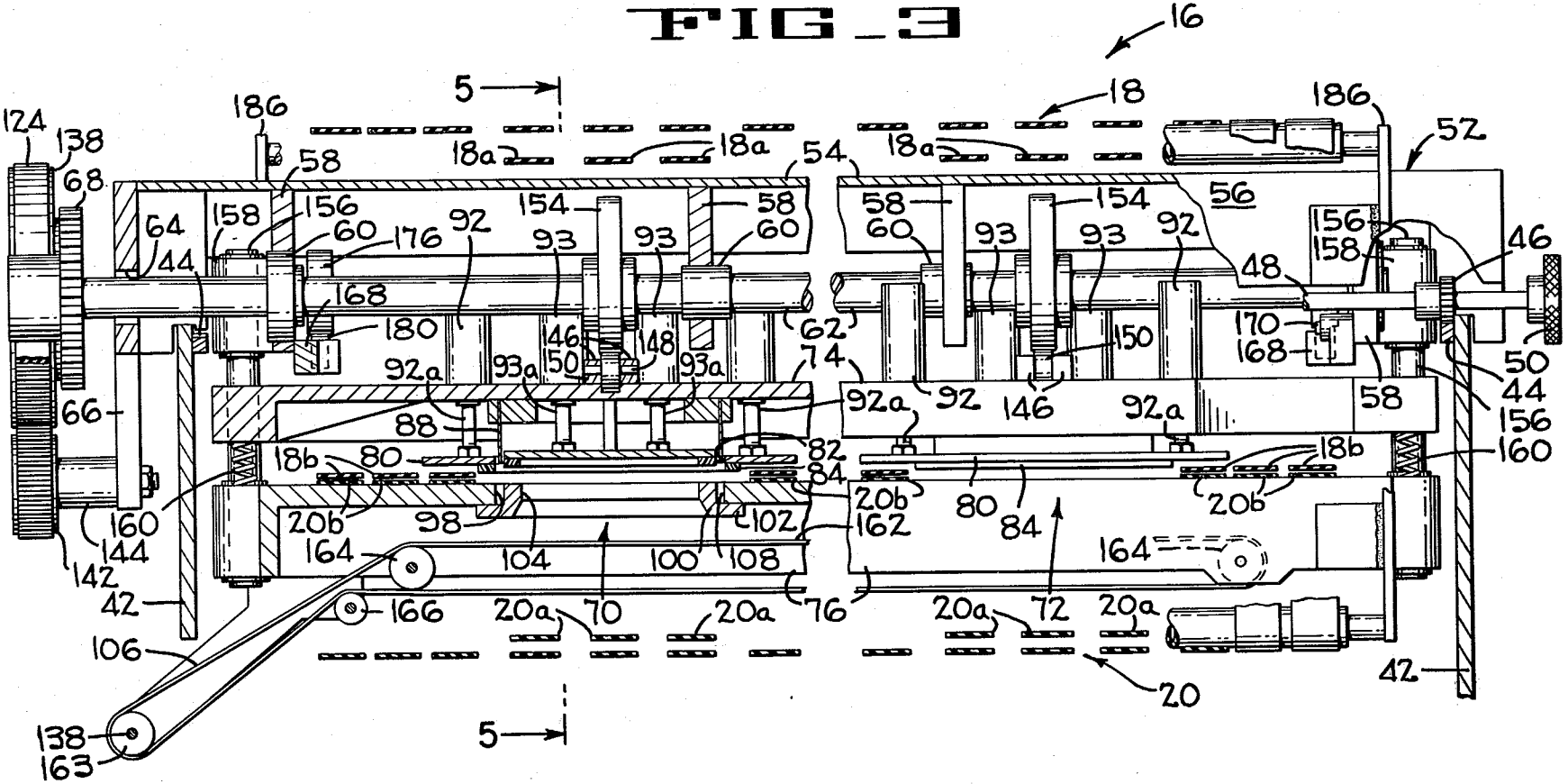
FIG. 3 is a vertical transverse section taken substantially along the offset line 3—3 of FIG. 2 illustrating details of the apparatus for cutting and removing a portion of material.
Figure 4:
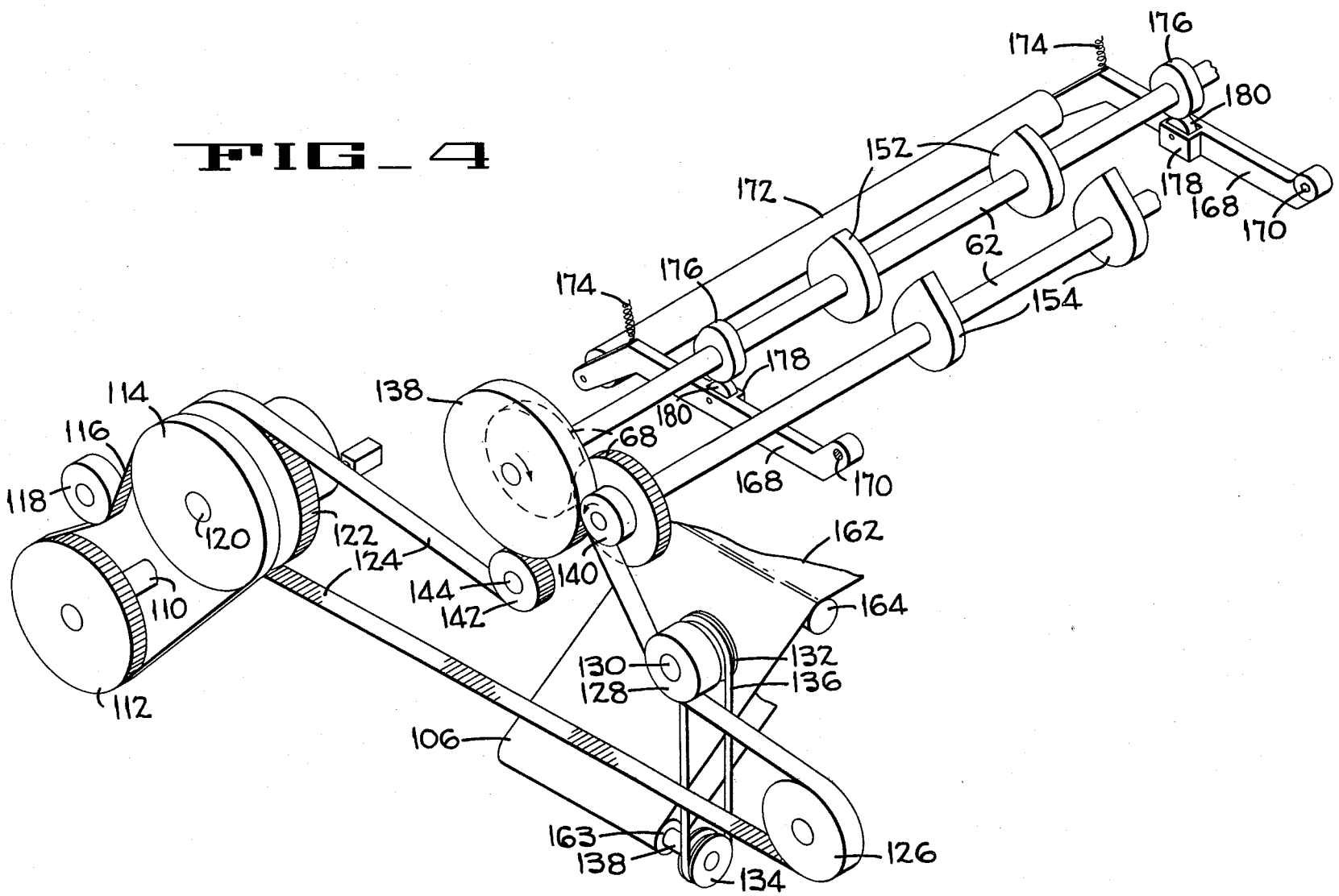
FIG. 4 is a perspective of the drive for the cutting mechanism.
Figure 5:
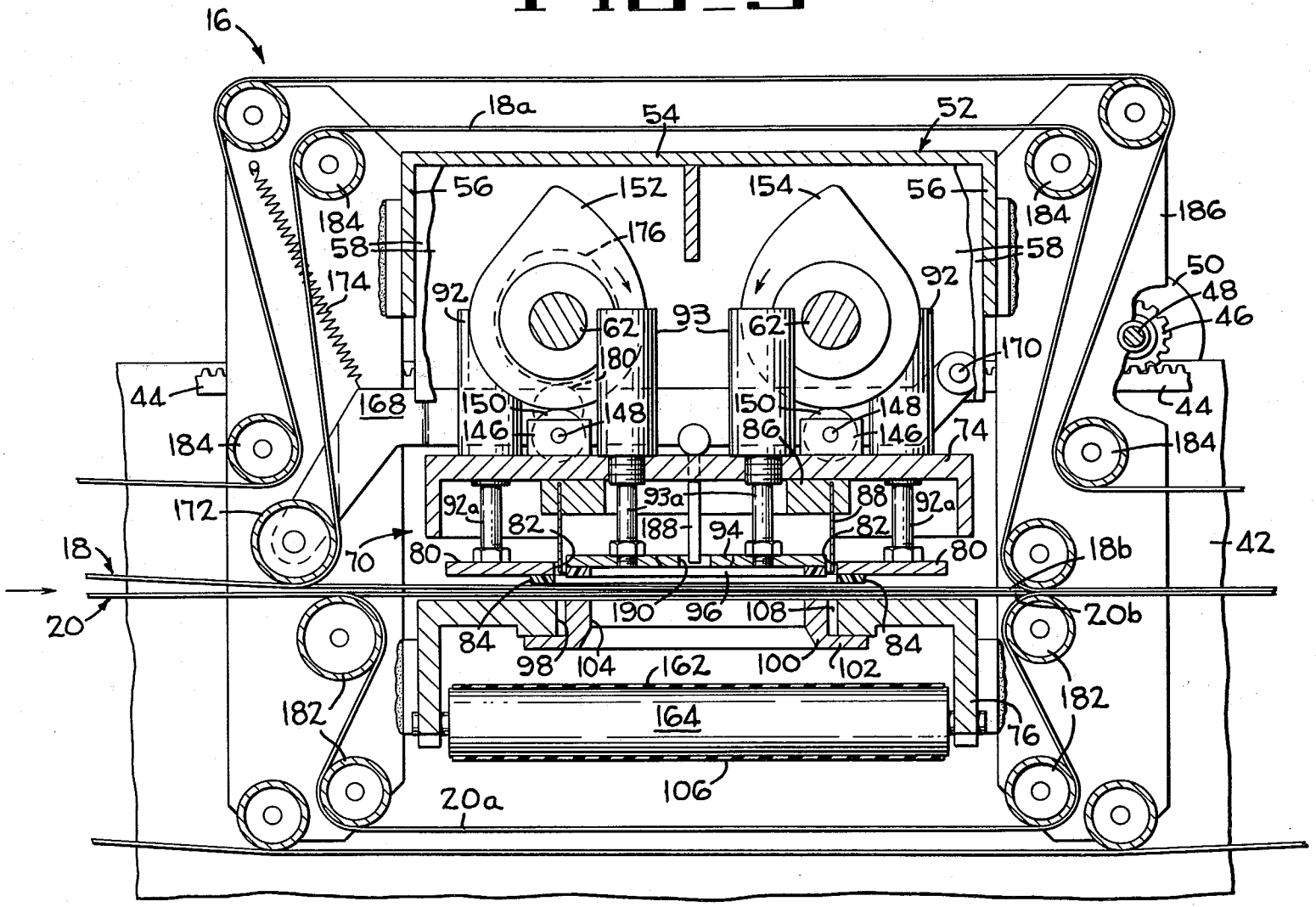
FIG. 5 is a section of the cutting mechanism taken substantially along the lines 5—5 of FIG. 3, FIGS. 6, 7, 8 and 9 diagramatically illustrate the sequence in cutting a portion from a gusseted web segment, FIG. 10 pictorially illustrates one form of a T shirt bag produced by the apparatus of the present invention.
Figure 11:
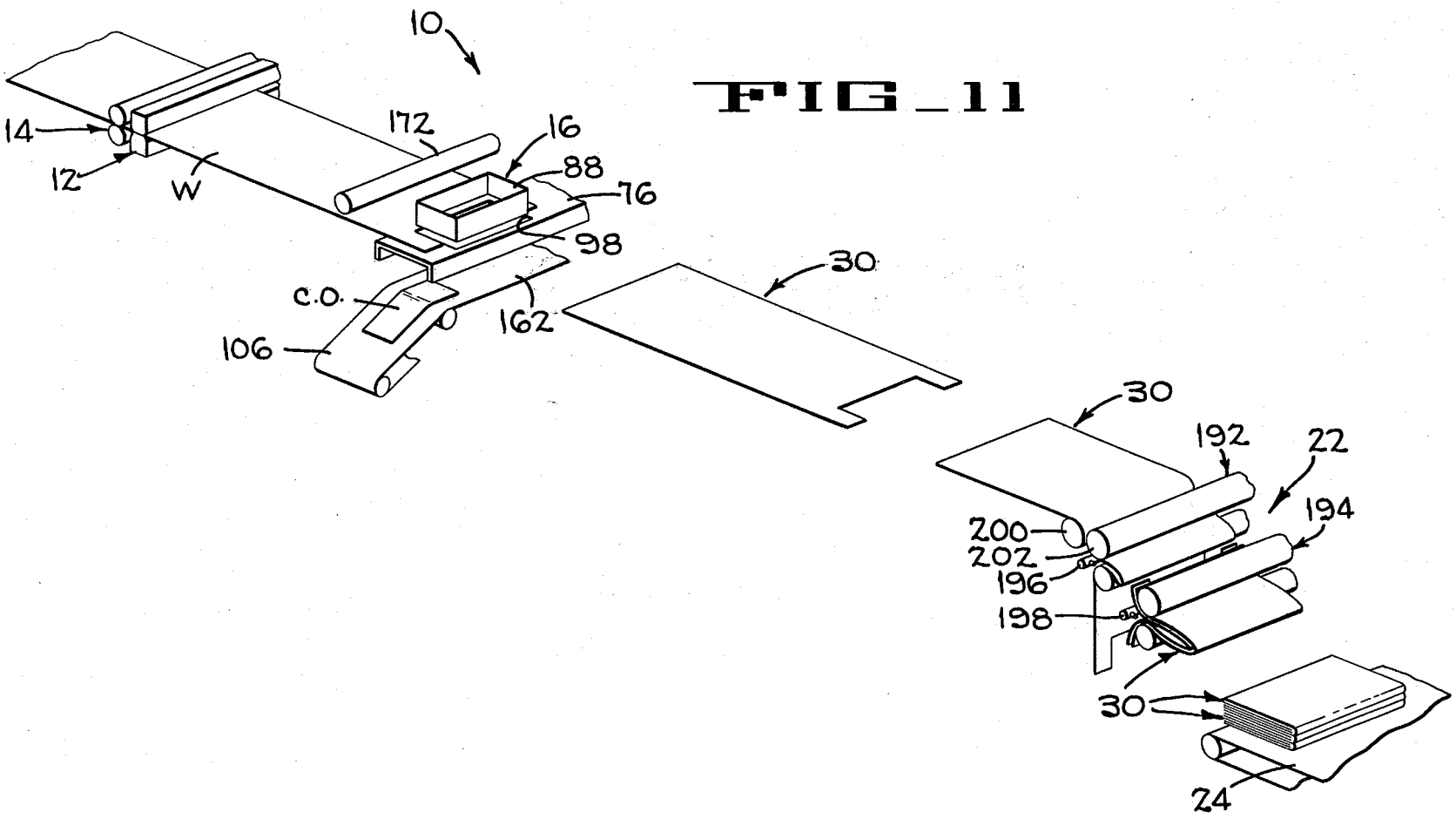
FIG. 11 is a diagramatic perspective of the sequence of operations producing folded T shirt bags.

FIGS. 2, 3, 4 and 5 illustrate the constructional features of the reciprocating mechanism 16. Referring first to FIG. 5, the preferred construction includes mechanisms for translating the position of the mechanism 16 with respect to the seal bar, depending upon the length of the bag to be made. Translation is achieved by providing transversely aligned and spaced upstanding plates 42 having rigidly mounted at the upper edge and on the inner surface, gear racks 44 meshing with gears 46 mounted on a shaft 48 which is rotated by a hand wheel 50 secured to a lateral extension of the shaft 48. The upper edge of the plates 42 provide a support for a box-like structure 52 comprising an upper plate 54 formed with downturned portions 56 to thereby form a transversely extending channel (FIG. 5). Extending between the downturned portions 56, and attached to the plate 54 and the portions 56, are a plurality of laterally spaced downwardly extending ribs 58 in which are mounted aligned bearings 60 rotatably supporting shafts 62 extending through clearance holes 64 formed in a bracket 66. As shown in FIGS. 2 and 3, the shafts 62 extend beyond the bracket 66 and the ends thereof are keyed to meshing gears 68.

As shown most clearly in FIG. 2, the reciprocating mechanism 16 is a "2-up head" meaning that two webs are simultaneously processed. Accordingly, the mechanism 16 is constructed to simultaneously process two webs and this is accomplished by providing duplicate (in construction and mode of operation) cutting positions 70 and 72. Accordingly, in describing the reciprocating mechanism 16, it is to be understood that interchangeable reference may be made with respect to the cutting positions 70 and 72.

As will be described presently, cutting and removing a generally rectangular portion from the thermoplastic web in accordance with the construction and mode of operation disclosed herein meets the objective of providing a self contained assembly which can be moved forward or away from the seal bar 12 in response to the length of bags desired. Moreover, the constructional arrangement provides a mechanical drive designed to balance the dynamic forces during the cutting operation which insures longevity and trouble free operation since unbalanced forces which would tend to cause deterioration between machine elements that move relative to each other are balanced such that the net forces are reduced to an absolute minimum.

To achieve the above identified objectives, the mechanism 16 includes an upper reciprocating platen 74 and a lower stationary platen 76. A series of actuators 92 and 93 are mounted in threaded bores formed in the upper platen 74. The rods 92*a* and 93*a* are in turn fixed to an outer presser plate 80 and a central presser plate 94. The rods 92*a* and 93*a* are continually biased toward an extended position either by a spring or air maintained at a selected pressure. The presser plate 80 is formed with a rectangular opening 82 having attached to its lower surface a compressable elastomeric strip 84 even with the opening 82. The upper platen carries, by means of a mounting block 86, a knife 88 formed to produce cuts along lines 38 and 40. With reference to FIG. 5 it will be seen that the knife 88 is located adjacent to the rectangular opening 82. The central presser plate 94 is also provided with an elastomeric strip 96. The lower stationary platen 76 is formed with a generally central rectangular central opening 98 conforming in shape and size to the rectangular opening 82 in presser plate 80. Joined to the lower platen, in any suitable manner such as by threaded fasteners or by welding and within the rectangular opening 98, is an insert 100.

As shown in FIG. 5, the insert 100 is formed with a flange 102 and a central opening 104 through which, as will be presently explained, the cut-out portion of web material passes for reception by a scrap conveyor 106 operating to convey scrap material transversely of the path of the gusseted web. The insert 100, together with the lower platen 76, provides a slot 108 for receiving the knife 88.

Reciprocation of the upper platen 74 in synchronism with the operation of the bag machine is achieved by the driving arrangement shown in FIG. 4. As is conventional, the bag machine drive includes a main input shaft 110 having keyed thereon a tooth pulley 112 driving a similar pulley 114 by a timing belt 116 held in tension by an idler pulley 118. Pulley 114 and a pulley 122 are mounted on a clutch brake shaft 120. Pulley 122 drives a timing belt 124. In driving the shafts 62, the timing belt passes around an idler pulley 126 and a pulley 128 rotatably mounted on a stub shaft 130 carried by the bracket 66. Also mounted on the stub shaft 130 is a grooved pulley 132 driving a pulley 134 by a belt 136. The pulley 134 is keyed to a shaft 138 driving the scrap conveyor 106. The timing belt 124 is wrapped around a timing pulley 138 keyed to one of the shafts 62, thereby driving both shafts by virtue of the meshing gears 68. A large arc of contact of the belt 124 around the pulley 138 is achieved by idler pulleys 140 and 142. The pulley 142 is rotatably mounted on a short stub shaft 144 carried by the bracket 66 as shown in FIG. 3.

By virtue of this driving arrangement, movement of the mechanism 16 along the upper edges of the plates 42 by means of the rack and pinion arrangement allows longitudinal movement in response to the bag size to be produced and yet the described driving arrangement can be maintained since the path of the driving belt 124 is maintained.

The upper platen 74 is driven downwardly to project the blade 88 through the portion of the web located within its projected area. Reciprocation of the platen 74 is accomplished by rigidly mounting, laterally spaced ears 146 to its upper surface and rotatably mounting therebetween, on a short pin shaft 148, a cam follower roller 150. The upper platen 74 is reciprocated by cams 152 and 154 (FIG. 4) rigidly secured to the shafts 62 which, as mentioned above, are concurrently driven by the belt 124 through the agency of the meshing gears 68. The shafts 62 and the cams associated therewith are rotated in opposite directions and therefore, the forces produced which may tend to create or impose bending moments on the platen 74 balance each other and accordingly smooth action and extended life between relatively moving surfaces result.

As shown in FIGS. 2 and 3, the upper platen 74 is guided for rectilinear movement by guide pins 156 each of which have one end secured in the lower platen 76 and the other end fixed in an ear 158 rigid with the outer ribs 58. Between the upper and lower platens 74 and 76, and mounted adjacent each of the pins 156, compression springs 160 bias the platen 174 upwardly and insure that rolling contact between the cam follower rollers 150 and the cams 152 and 154 is maintained.

As shown best in FIG. 3, the scrap conveyor 106 has a feeding reach 162 extending below both of the inserts 100 so that the punched out portion of web material may be transported laterally of feed path of the web material. The scrap conveyor includes a driven roller 163 mounted on the shaft 138, idler rollers 164 and a return reach diverting roller 166.

Positive ejection of the scrap of web material cut by the knife 88 is preferably accomplished by providing a tube 188 connected to a source of pressure air and being fixed to the upper platen 74. The tube partially projects into the central presser plate 194. An enlarged opening 190 insures the diffusion of pressure air to positively remove the cut-out portion of web material and propel it to the conveyor 106.

After the generally rectangular cut-out has been made in the web segment, advance of the web segment to the folding means 22 is achieved by pressing the belts 18 and 20 together. In the art such means are sometimes referred to as a pickoff mechanism. Pick off is achieved by providing (FIG. 4) offset levers 168 having one end pivotally connected at 170 to the outmost ribs 58 and the other end rotatably mounting a roller 172. The roller 172 extends for the entire length of the reciprocating unit 16. The levers are biased upwardly by springs 174 and timed reciprocating movement downwardly compressing the belts 18 and 20 is achieved by providing cams 176 mounted on the shaft 162 as shown in FIG. 4. Each of the levers 168 are formed with an integral pocket 178 in which is rotatably mounted a cam follower roller 180, held in rolling engagement with cams 176 by the springs 174. In view of this arrangement, during each cycle of operation, the levers 168 are cammed downwardly squeezing the completed bag between the belts 18 and 20 for advancement to the folding means 22.

The upper and lower conveying means 18 and 20 respectively comprise, as shown in FIG. 3, a plurality of laterally spaced relatively narrow flat belts, some of which are diverted around reciprocating unit 16 so that their path does not fall in the projected area of the knife 88 and certain of the belts are directed over the lower platen 76. To effect diversion of selected belts, a plurality of idler rollers, all of which are collectively identified by the numeral 182, divert belts 20*a* (FIG. 5) to pass under the cutting knife 88 while belts 20*b* pass over the lower platen 76. Diversion of the upper conveying means 18 follows a similar pattern by diverting reaches 18*a* while reaches 18*b* are adjacent the reaches 20*b*. The non-diverted reaches position the web segment properly with respect to the knife 88 and thereby insure accurate location of the cut-out portion. All of the belts 18 diverted around the reciprocating unit 16 pass around roller 172 and are tracked as shown in FIG. 5 by idler rollers 184 which are rotatably supported in end plates 186 attached in any suitable manner to the frame of the reciprocating mechanism 16.

In operation, when a web segment is advanced by the draw rolls 14, the leading portion of the segment is positioned within the projected area of the knife 88 to effect cutting along the longitudinal incisions 38 and the transverse incision 40 as described above. With the fed web segment at rest, the twin sealing device 12 descends to effect sealing and severing of the advanced web segment. During a portion of the time required to effect sealing the reciprocating mechanism 16 descends clamping the web by presser plate 80 and the central presser plate 94 firmly clamping the web before the knife 88 cuts the web along lines 38 and 40. The cut-out C.O. is removed by the air issuing through tube 188 after the upper platen raises, releasing the clamping pressure of the presser plate 94 and then the presser plate 80. The cut-out portion is received on conveyor 106 and discharged.

The above sequence of operations is illustrated in FIGS. 6–9 wherein the leading portion of the web segment is shown clamped between the presser plates 80 and 94 with the leading edge of the web segment substantially even with the edge of the central presser plate 94. Continued rotation of the shafts 62 displaces the upper platen 74 to its downward limit and thereby effects cutting of the web segment along lines 38 and 40. Thereafter, (FIG. 7) continued rotation of the shaft 62 raises the upper platen 74 releasing the clamping pressure on the web segment. Air introduced through the tube 188 blows the cut-out portion toward a conveyor 106 while the presser plate 80 is still in contact with the lower platen 76.

Completion of a bag making cycle occurs when the seal bars 12 are separated after sealing and severing of the advanced web segment has been accomplished. At this time, cams 176 pivot the offset levers 168 downwardly, causing the pick-off roller 172 to firmly press the belt reaches 18*b* and 20*b* together to thereby advance the completed bag toward the folding mechanisms 22.

The folding mechanism comprises first and second sets of folding rolls 192 and 194, respectively. The bag is sequentially directed to the nip of folding roll 192 and 194 by air issuing from air tubes 196 and 198 directing jets of air to the nip of the folding rolls.

U.S. Pat. Nos. 3,766,701 and 3,859,898 to Besserdich et al disclose a folding apparatus similar in construction and having a mode of operation as the folding apparatus 22 disclosed herein. By reference to this prior art it is intended that their disclosures be incorporated herein. As the completed bag is transported by the belts 18 and 20, the bag is directed by the lower reach of belt 18 that passes between a turning roll 200 and a roll 202 in contact therewith. The bag is directed vertically downwardly and guided for such movement by wires 204 and 206. A conventional photo reflective device 208 detects the trailing edge of the bag energizing circuit controlling flow of air to the air tube 196 which impels the mid portion of the bag toward the nip of the folding rolls 192. The bag with the single fold is directed by belts 18 between the wires 206 and a generally L shaped wire 210. The air tube 198 is programed for operation by a time delay and the jets of air directed toward the nip of folding rolls 194 makes one additional fold. The twice folded bag is discharged to the stacking station 28. FIG. 10 diagramatically illustrates the action of the folder 22. Upon accumulating a stack having a selected number of bags the conveyor 24 is operated to transport the bag stack away from the stacking station 28.

Although the best mode contemplated for carrying out the present invention has been herein shown and described, it will be apparent that modification and variation may be made without departing from what is regarded to be the subject matter of the invention as defined in the appended claims.

What we claim is:

1. A thermoplastic bag making apparatus comprising means, located in the processing path of thermoplastic web, for converting a segment of the web which is heat sealed at both ends by cutting out a rectangular portion to produce hand-grasping handles at one end, means for conveying the leading portion of the web toward and away from said converting means, said conveying means comprising upper and lower sets of transversely spaced bands following a linear path to said converting means, and means at the entrance and discharge of said converting means for diverting selected ones of said bands away and toward the linear path so that said diverted bands are not within the projected area in which cutting occurs while bands following the linear path conveys the web segment from said converting means.

2. The thermoplastic bag making apparatus according to claim 1 further comprising means operable to press said conveyor bands together for effecting advancement of the web segment away from said converting means after cutting has been effected.

3. The thermoplastic bag making apparatus according to claim 2 wherein said advancing means comprises a roller overlying said conveyor means and being rotatably mounted in levers, and means for oscillating said levers toward and away from said conveyor means to press the conveyor bands and thereby advance the completed bag away from said converting means.

4. The thermoplastic bag making apparatus according to claim 3 wherein cams operated in synchronism with the advance of the web segments effect oscillation of said levers.

5. The thermoplastic bag making apparatus according to claim 1 wherein said converting means comprises cooperating platens being opened and closed in synchronism with the advance of the web segments, means for opening and closing said platens, means carried by one of said platens for cutting the rectangular portion when said platens are closed, and means carried by one of said platens for clamping the web segment adjacent the lines defining the removed rectangular portion.

6. The thermoplastic bag making apparatus of claim 5 wherein said platens comprise an upper moveable platen and a lower stationary platen, a knife formed to cut the rectangular portion mounted on said upper platen, and means carried by said upper platen and mounting said clamping means for clamping the web segment before and after said upper platen reaches its limit of travel toward said lower platen to insure clamping of the web segment before cutting is effected.

7. The thermoplastic bag making apparatus according to claim 1 further comprising means carried by said converting means for ejecting the rectangular portion from the leading portion of the web, and means for receiving and conveying the rectangular portion away from the path in which the web is processed.

8. The thermoplastic bag making apparatus according to claim 7 wherein said ejecting means comprises a conduit being directed to discharge a stream of pressure air to the area of the web from which the rectangular portion is removed.

9. The thermoplastic bag making apparatus according to claim 6 further comprising driving mechanism moving said upper platen toward said lower platen, said drive comprising a transmission, an input shaft driven by the drive of a bag machine, drivingly connecting another shaft to said input shaft so that said input shaft and said another shaft are driven in opposite directions, axially spaced cams mounted on each of said shafts, and cam follower rollers carried by said upper platen and held in rolling contact with said cams to effect movement of said upper platen.

10. The thermoplastic bag making apparatus according to claim 9 further comprising a conveyor having a feeding reach below said lower platen and means connected to said transmission for driving said conveyor.

11. An apparatus for producing thermoplastic handle bags by cutting and removing a generally rectangular portion from one end of intermittently advanced gusseted web segments having transverse seals at each end, said removed rectangular portion defined by cutting the web segment along planes including the inner creases of the gussets and along a plane substantially parallel to the seals thereby producing hand grasping loops, the improvement in said apparatus comprising conveyors bands having opposed closely adjacent reaches for transporting and maintaining web segments introduced between said reaches in a planar condition, said conveyors comprising a plurality of regularly spaced transversely adjacent belts, means, in the path of said conveyors, for cutting and removing the rectangular portion from web segments while being maintained between said reaches, and means for diverting selected belts of each conveyor away from the path of said web segments.

* * * * *